US005773394A

United States Patent [19]

Wan et al.

[11] Patent Number: 5,773,394

[45] Date of Patent: Jun. 30, 1998

[54] CONDUCTING POLYMER-THICKENED GREASE COMPOSITIONS

[75] Inventors: George Tin Yau Wan, Houten; Dick Meijer, Nieuwegein, both of Netherlands

[73] Assignee: SKF Industrial Trading & Development Company B.V., Netherlands

[21] Appl. No.: 814,031

[22] Filed: Mar. 10, 1997

[30] Foreign Application Priority Data

Mar. 12, 1996 [NL] Netherlands ..... 1002587

[51] Int. Cl.[6] ..... C10M 119/02

[52] U.S. Cl. ..... 508/591; 508/131; 508/150; 508/166; 585/12

[58] Field of Search ..... 508/591, 131, 508/150, 166; 585/12

[56] References Cited

U.S. PATENT DOCUMENTS

| | | | |
|---|---|---|---|
| 2,901,432 | 8/1959 | Morway et al. | 585/12 |
| 2,917,458 | 12/1959 | Morway et al. | 508/534 |
| 3,076,764 | 2/1963 | Hansen et al. | 585/10 |
| 3,114,708 | 12/1963 | Morway et al. | 508/591 |
| 3,216,935 | 11/1965 | Morway et al. | 508/286 |
| 3,290,244 | 12/1966 | Polishuk et al. | 508/525 |
| 3,392,119 | 7/1968 | Mitacek | 585/12 |
| 3,850,828 | 11/1974 | Dodson et al. | 585/12 |
| 3,928,214 | 12/1975 | Naka et al. | 508/166 |
| 4,075,112 | 2/1978 | Van Doorne | 585/12 |
| 4,075,113 | 2/1978 | Van Doorne | 585/12 |
| 4,435,299 | 3/1984 | Carley et al. | 508/512 |
| 5,139,425 | 8/1992 | Daviet et al. | 439/17 |

FOREIGN PATENT DOCUMENTS

| | | |
|---|---|---|
| 699334 | 12/1964 | Canada . |
| 905924 | 7/1972 | Canada . |
| 0 675 192 A1 | 10/1995 | European Pat. Off. . |
| 0 700 986 A3 | 3/1996 | European Pat. Off. . |
| 6 322436 | 11/1994 | Japan . |
| 799465 | 8/1958 | United Kingdom . |

OTHER PUBLICATIONS

Chemical Abstracts, vol. 78, No. 14, Apr. 9, 1973, Columbus, Ohio, US; Abstract No. 86956m.

Chemical Abstracts, vol. 78, No. 14, Apr. 9, 1973, Columbus, Ohio, US; Abstract No. 86955k.

Database WPI, Section Ch, Week 9440, Derwent Publications Ltd., London, Class A17, AN 94–322436.

Database WPI, Section Ch, Week 7920, Derwent Publications Ltd., London, Class A97, AN 79–38210B.

*Primary Examiner*—Ellen M. McAvoy

*Attorney, Agent, or Firm*—Oliff & Berridge, PLC

[57] ABSTRACT

An electrically conducting polymer thickened grease composition containing 1) a lubricating base oil, 2) a polymer thickener, 3) an electrically conducting component, 4) optional further additives, is provided.

The polymeric thickener is a mixture of (1) a (co- or homo-)polymer of propylene with a weight average molecular weight >200,000 and (2) a (co- or homo-)polymer of propylene with a weight average molecular weight <100,000. The electrically conducting component is preferably a metal containing additives, an anti-static agents or an electrically conducting solid. The grease composition can conduct electricity through the parts of a roller bearing, not only under static conditions, but also during use. This makes the greases especially suited for use in roller bearings with rotating electrical contacts. The grease can further reduce or prevent the build-up of static electricity and spark formation in roller bearings.

20 Claims, 3 Drawing Sheets

CONDUCTING POLYMER-THICKENED GREASE COMPOSITIONS

BACKGROUND OF THE INVENTION

1. Field of the Invention

The present invention relates to conducting lubricants. In particular, the present invention relates to conducting greases that contain a polymeric thickener.

2. Discussion of Related Art

Over the last few years, the interest in electrically conducting lubricating greases has greatly increased, especially for automotive applications. Such conducting greases would prevent the build up of static electricity in the bearing under use, would provide for earthing of the bearing and could be used for electric conduction in or through the bearing, especially between the different parts or surfaces making up the bearing.

Despite the presence of the metal soap thickener, conventional soap-thickened lubricating greases are classed as insulators. This is probably due to the high electrical resistivity of the oil film which is formed on the bearing surfaces ($>10^{10}$ ohm meter) during use.

Some electrically conducting lubricants are known in the art. One example is the lubricant marketed under the trade name Orapi GRN, which comprises a dispersion of graphite in a lubricating base oil. This and similar conducting lubricants contain no thickener component; because of this, they show inadequate or even poor lubrication properties compared to conventional non-conducting greases. In particular, the known conducting lubricants have insufficient mechanical stability as well as limitations at high rolling speeds so that they cannot be used (reliably) in for instance automotive applications.

A first object of the invention is therefore to provide improved electrically conducting lubricating compositions, especially with better lubricating properties than conventional conducting lubricants and/or with conducting properties comparable to, or even better than, those of the known conducting lubricants.

As part of their research, the present inventors have investigated the conducting properties of several conducting lubricants (including the known graphite-in-oil lubricants) in both a "static" conductivity test (in which two electrodes are put into a lubricant mass and the resistance/resistivity of the mass is measured), as well as in actual running bearings, wherein the resistance to the flow of electricity between parts and/or surfaces of the bearing is measured.

In doing so, the inventors surprisingly have found that the conductivity provided by a lubricant under static conditions cannot be used reliably to predict the conductivity under actual use in a bearing, especially in a running bearing. In particular, the inventors have found that whereas known conducting lubricants provide adequate conductivity in static tests, their conductive performance in actual bearings, and especially in running bearings at higher bearing speed, is inadequate.

Therefore, a further object of the invention was to provide electrically conducting lubricating compositions which give good conducting properties in running bearings.

Some polymer thickened lubricating greases are known in the art.

For instance, U.S. Pat. No. 3,850,828 describes a lubricant grease composition, which is thickened with a polymeric mixture, comprising (1) a polyethylene with a molecular weight of 20.000–500.000, more preferably 50.000–250.000 and preferred polymer density above 0,94 gm/cc, and (2) an atactic polypropylene with a molecular weight preferable below 100.000 and a melt index above 20, preferably above 50. The ratio of the atactic polypropylene to the polyethylene is preferably 1:1 to 10:1, more preferably 2:1 to 5:1.

U.S. Pat. No. 2,917,458 describes a grease composition comprising an oil soluble amorphous polypropylene base having a molecular weight in the range of 300–10,000 and an intrinsic viscosity up to 0.4, 2 to 5 wt. % of an isotactic polypropylene having a molecular weight in the range of 100,000 to 1,000,000 and a melting point in the range of 250° to 410° F., and 5 to 35 wt. % of a soap-type thickener.

U.S. Pat. No. 3,290,244 describes a grease composition comprising a mineral lubricating oil, a thickening agent, and an oil soluble atactic homopolymer of polypropylene having a molecular weight in the range of 10,000–50,000 or an oil soluble atactic copolymer of ethylene and propylene having an intrinsic viscosity in the range of 0.3 to 4.0.

As a thickener, conventional thickeners such as fatty acid metallic soaps, inorganic thickeners such a colloids, silica and bentonite clay, etc. can be used in amounts of 5 to 40%.

U.S. Pat. No. 3,392,119 describes a grease comprising a white mineral oil that has been thickened by the use of an ethylene-copolymer with a density at 25° C. of at least 0.4 g/cm$^3$ and a polypropylene homopolymer with a density at 25° C. of between 0.890 and 9.20 g/cm$^3$, the polyethylene to polypropylene weight ratio generally being in the range from about 10:1 to 1:10, preferably 3:1 to about 1:2.

The non-prepublished EP 95202464.4 and its priority application 94202323.5, both of which are incorporated herein by reference, describe polymeric thickeners for lubricating grease compositions, comprising a mixture of 1) a (co- or homo-) polymer of propylene with a weight average molecular weight >200.000 as a high molecular weight component, and
2) a (co- or homo-)polymer of propylene with a weight average molecular weight <100.000 as a low molecular weight component.

The low molecular weight component is preferably a polypropylene homopolymer with a weight average molecular weight between 50.000 and 100.000 with a melt flow rate (ASTM D-1238) of 500–1000, preferably 750–850.

The high molecular weight component is preferably a polypropylene homo- or a propylene/ethylene-copolymer with weight average molecular weight of 200.000–250.000 and a melt flow rate (ASTM D-1238) of 1.5–15, preferably 1.5–7.

The weight ratio between the high molecular weight component and the low molecular weight component in the polymeric thickener is preferably 1:40–1:5, more preferably 1:25–1:15, more preferably about 1:19.

EP 95202464.4 also describes a lubricating grease composition comprising a lubricating base oil and said polymeric thickener, as well as a preferred method for preparing said grease composition, which comprises the following steps:

a) preparing the above mentioned thickener composition;
b) mixing/dissolving this thickener with/in a lubricating base oil at a temperature above the melting point of said polymer, preferably 190°–210° C., and
c) cooling the grease composition thus obtained from the mixing temperature to room temperature in 1 sec.–3 min., preferably 10 sec.–1 min., more preferably around 30 sec.

This preferred method of preparation, which comprises rapid cooling of the grease composition, is referred to as "quenching".

It is stated that the grease compositions according to EP 95202464.4 have improved oil bleeding characteristics at low temperature, improved noise characteristics and improved mechanical stability, especially when they are prepared with "quenching".

However, none of the above-mentioned polymer-thickened lubricating greases are said or suggested to be electrically conducting. Also, their use in preventing the build up of static electricity and/or spark formation, as well as their use in electric motor applications are neither described nor suggested.

Some conducting greases containing a polymeric component are also known.

For instance, Derwent Abstract 94-322436 (NTN Corporation) describes soap thickened greases or non-soap polyol ester type lubricating greases, to which is added (1) 95–1 wt. % of one or more ultra-high molecular weight polyolefins and (2) a conductive powder component, chosen from acetylene black, carbon black, metal particles and/or sulfur oxide. However, as according to this abstract, the polymeric component is added to a conventional grease, it does not necessarily relates to a polymer thickened grease composition.

Derwent Abstract 79-38210B (Mitsubishi Electric Corp.) describes a conductive lubricant grease comprising a linear polyolefin, a metal activator and flake-like silver powder coated with a saturated fatty acid and its silver soap. From this disclosure, it is not clear whether the linear polyolefin is added to a conventional grease composition (i.e. containing a conventional soap thickener), or whether it is the (only) thickener component.

Chem. Abstracts 1973, No. 86955k (Mitsubishi Electric Corp.) relates to greases containing silver particles coated with saturated fatty acids or silver soaps, metal-inactivating agents and fibrous polyolefins. The disclosure of this abstract appear to be very similar to that of the abovementioned Derwent abstract 79-38210B; in particular, it appears that the polymeric component is added to a conventional grease composition, as the amount of polymer used (0.5–10 wt. %) would be insufficient to act as a thickener per se.

Chem. Abstracts 1973, No. 86956m (also Mitsubishi Electric Corp.) describes an electroconductive grease similar to that of the preceding abstract 86955k, which comprises carbon black as the conductive component instead of coated silver particles. Again, particular, it appears that the polymeric component is added to a conventional grease composition, as the amount of polymer used (0.5–10 wt. %) would be insufficient to act as a thickener per se.

Furthermore, none of the abovementioned abstracts discloses or suggests conducting grease compositions comprising the specific polymeric thickener of the abovementioned European application 95202464.4.

SUMMARY OF THE INVENTION

It has now been found that lubricating greases which are thickened with a polymeric thickener according to European application 95202464.4 provide improved conductivity and/or reduced resistivity compared to both equivalent soap-thickened lubricating greases as well as known conducting lubricants, such as Orapi GRN.

In a first aspect, the present invention therefore relates to the use of a polymeric thickener according to European application 95202464.4 in the preparation of an electrically conducting lubricant grease composition, especially for bearing applications.

When this polymeric thickener is used, besides the improved electric conductivity in bearing applications, the grease is also provided with the favourable lubrication properties described in the European application 95202464.4, i.e. excellent oil bleading characteristics at low temperatures, excellent mechanical stability and low-noise characteristics, in particular compared to the abovementioned polymer containing conductive lubricants.

Furthermore, for high temperature applications, or when the conducting of electricity can result in an increased temperature of the grease, the polymeric thickener can further comprise a polymer/thickener with a high melting point, as is described in applicants co-pending Dutch application 1002586, with the same filing date as the present application, also incorporated herein by reference.

According to the invention, the polymeric thickener is used/incorporated as a thickener in a grease composition, which further contains at least a lubricating base oil and at least one substance which is capable of conducting electricity and/or which provides for the conductivity and/or the low(ered) resistivity of the grease composition. In such an application, the use of a polymeric thickener will result in an increased conductivity and/or a decreased resistivity, compared to the use of a conventional soap thickener in a otherwise analogous grease.

The polymeric thickener can also be used in/added to conventional conducting lubricants to improve at least the lubricating properties, and preferably also the conducting properties thereof.

In a further aspect, the invention relates to an electrically conducting lubricant, comprising:

1) a lubricating base oil
2) a polymeric thickener
3) an electrically conducting component, and
4) further additives for lubricant grease compositions known per se, characterised in that the polymeric thickener comprises a mixture of (1) a (co- or homo-)polymer of propylene with a weight average molecular weight >200.000 and (2) a (co- or homo-)polymer of propylene with a weight average molecular weight <100.000.

DETAILED DESCRIPTION OF PREFERRED EMBODIMENTS

Figure 1:
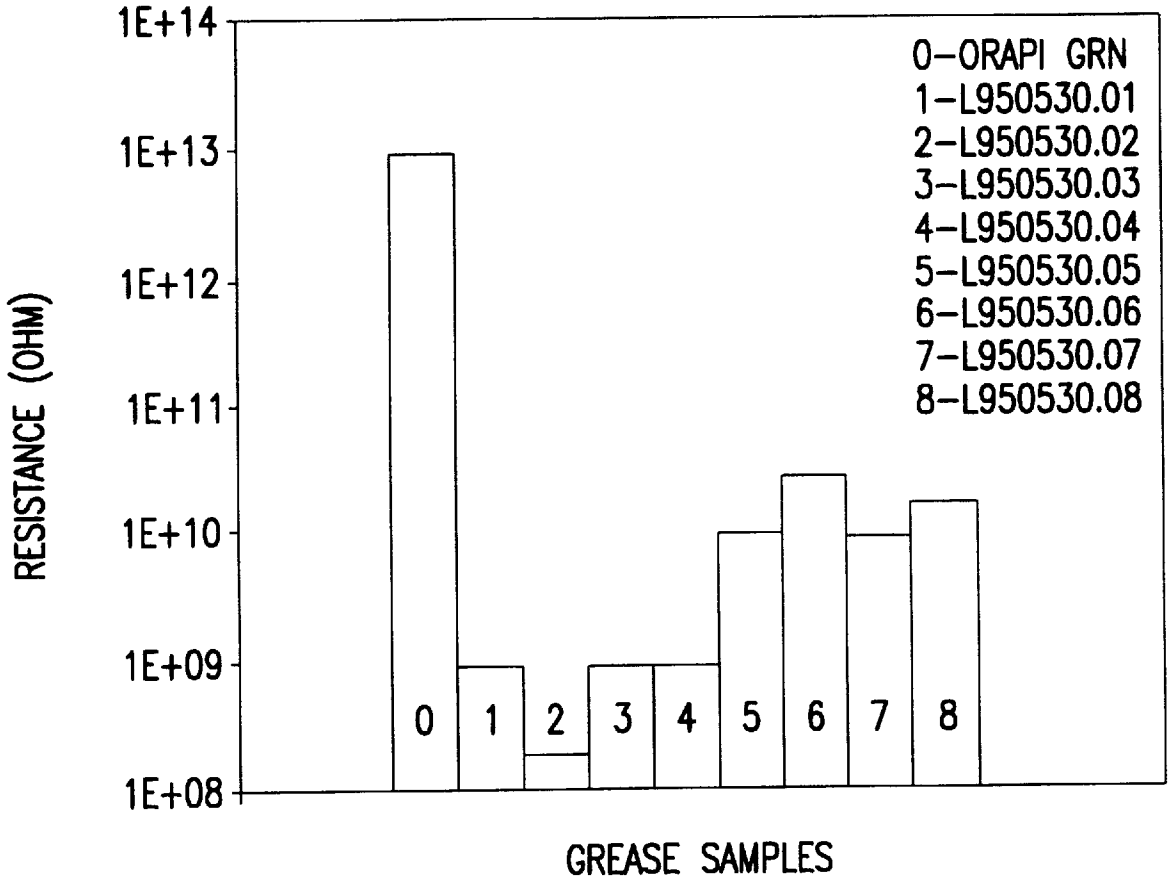
FIG. 1 is a diagram showing the resistance of known lubricants and lubricants of the invention in static tests.

The electrically conducting grease compositions of the invention preferably have a resistance (measured in a standard bearing (6205) as described hereinbelow at speed index NDM 100.000 and at ambient temperature) of less than 100 ohm, more preferably less than 1 ohm.

The electrically conducting component 3 can be any substance which provides for electric conductance and/or low(ered) resistivity of the grease without detracting (or detracting too much) from the lubricating properties. It can for instance be a liquid or a solid at room temperature and/or the operating temperature of the grease; it can dissolve in either the lubricating oil or the thickener, or it can form a separate phase within the grease structure, for instance in case of solid particles. The electrically conducting component 3 can also be deposited on the bearing surfaces.

The electrically conducting component 3 preferably comprises at least one, more preferably a combination of at least two chosen from

3*a*) (at least one) metal containing additive.

3*b*) (at least one) anti-static agent; and/or

3*c*) (at least one) electrically conducting solids;

Most preferably, the electrically conducting component 3 is a combination of all three from 3*a,* 3*b* and 3*c*.

As the lubricating base oil any lubricating oil known per se may be used, such as mineral oils, synthetic hydrocarbons, ester oils and mixtures thereof, of different viscosity. The type of base oil and viscosity can be selected to suit specific applications.

As the polymeric thickener, the polymeric thickener according to the abovementioned non-prepublished European application 95202464.4, which is incorporated herein by reference, is used; the preferred embodiments for said thickener as described in EP 95202464.4 are also preferred embodiments for the thickener used in the present invention.

As the metal containing additive 3*a,* preferably a organometallic compound and/or a bismuth additive is used, more preferably an organometallic bismuth compound, such as the Bi-containing grease additives known in the art. Also, other known metal containing grease additives known per se can be used.

As the anti-static agent, all anti-static agents for polymer applications which do not detract from the properties of the final can be used, such as antistatic antiblocking agents. A preferred example is especially Dehydat 51® (Henkel).

As the electrically conducting solid, any solid which can conduct electricity and which can suitably be dispersed in a lubricating oil or grease can be used. Preferably, these solids are such that they do not detract from the properties of the grease nor degrade the bearing surfaces during use. Examples of suitable conducting solids are (soft) metal particles, in particular of silver, copper, graphite, bismuth, Niobium (IV) sulfide. Graphite (conductive carbon) and Niobium (IV) sulfide are especially preferred.

The conducting solid 3*c* will generally have a small particle size, so that the solid particles will not interfere too much with the lubricating properties of the grease and/or the bearing surfaces during use. Preferably, particles with a maximum particle size no greater than less 30 micron, preferably no more than 10 micron, more preferably less than 5 micron are used. Particles with an average particle size of between 1 and 2 micron are preferred.

The base oil, the polymeric thickener and the metal-containing additives 3*a* can be used in conventional amounts. The anti-static agents 3*b* and the electrically conducting solids 3*c* can be used in amounts which are effective for providing the desired conducting (or anti-static) properties.

In general, the grease of the invention will have the following composition (in wt. % based on the total composition)

Base oil 30–99

Polymeric thickener 1–30

Electrically conducting component 0,01–20 the total of wt. %. making up 100%, the electrically conducting component 3) preferably comprising at least one, more preferably at least two of 3*a,* 3*b* and/or 3*c*.

A preferred composition (in wt. % based on the total composition) is

Base oil 30–98

Polymeric thickener 1–30,

Bi-additive 3*a* 0,1–10

Antistatic agent 3*b* 0,1–15

Conducting particles 3*c* 0,1–5 the total of wt. %. making up 100%.

With regard to the components 3*a,* 3*b* and 3*c,* it should be noted that greases which only contain a metal-containing additive 3*a* (such as an organobismuth compound), or a metal-containing additive 3*a* in combination with an anti-static agent 3*b,* show lower contact resistance/resistivity in a "static" conductivity test and at low bearing speeds of up to 500 r.p.m. than the known Orapi-lubricant, but show a strong increase in resistance and/or resistivity at higher bearing speeds, resulting in a higher resistivity then Orapi at 2500 rpm.

Greases which contain a metal-containing additive 3*a* and a conductive solid 3*c,* either with or without an antistatic agent 3*b,* show higher contact resistance/resistivity in a "static" conductivity test than a grease containing only 3*a* or 3*a*+3*b,* although this contact resistance/resistivity is still better than that of the Orapi lubricant.

However, in a running bearing, greases which contain at least the metal-containing additive 3*a* and a conductive solid 3*c,* surprisingly show lower resistance/resistivity than greases that do not contain a conductive solid, and this resistance/resistivity only increases slowly with increasing bearing speed, so that a high bearing speeds of around 2500 r.p.m., greases which contain a conductive solid 3*c* provide by far the best conductivity.

Therefore, for high bearing speed applications, as well as for the best "overall" performance in static conditions and at low and high bearing speeds, greases of the invention which contain a conductive solid 3*c* are strongly preferred.

Apart from the polymeric thickener, the lubricant grease composition may also contain conventional thickeners for lubricant grease compositions, such as metal soaps, in amounts of less than 50 wt. %, preferably less than 10 wt. %, as well as other polymeric thickeners, as long as these conventional thickeners do not adversly affect the conducting and/or lubricating properties of the grease. Most preferably, however, the lubricant grease compositions according to the invention contain only polymeric thickeners.

Besides the abovementioned components in the abovementioned amounts, additives known per se may be incorporated in the lubricant grease composition in the usual amounts, as long as they do not have a detrimental effect on the thickener composition, the base oil, the final grease composition and/or the conducting properties thereof. As such, anti-wear and anti-corrosion additives as well as anti-oxidants etc. may be incorporated in conventional amounts in a manner known per se.

The conducting lubricating greases of the present application can be prepared by mixing the oil with the polymeric thickener and electrically conducting component 3, preferably the one or more components 3*a,* 3*b* and/or 3*c,* and the optional further additives, preferably under a protective atmosphere, such as a nitrogen gasflow, for avoiding oxidation of the oils during heating.

In general, this method will comprise the following steps a) mixing/dissolving a polymeric thickener with/in a lubricating base oil at a mixing/dissolving temperature above the melting point of said thickener, b) incorporating into said composition electrically conducting component 3, and optionally further additives for lubricant grease compositions known per se.

c) cooling the grease composition thus obtained from the mixing temperature to room temperature.

d) working the grease to the required consistency.

It should be noted that in said method, the electrically conducting component 3, as well as the optional further additives 4, can be added to the polymeric thickener and/or the lubricating base oil prior to step a); during or after step a); during or after step c), or during step d), or any combination thereof. When the electrically conducting component 3 comprises the preferred combination of at least two components 3*a,* 3*b* or 3*c,* these components can be incorporated simultaneously and/or separately into the other starting components and/or during the preparation of the grease.

It should also be noted that according to the invention, by choosing the different components (including additives and other thickeners) to be incorporated in the grease composition as described herein, as well as the amounts in which these are used, the man skilled in the art will be able to control the conducting properties of the final composition so as to obtain a grease with the desired conductivity for the intended use.

Preferably, the conducting grease compositions are prepared via the preferred method of "quenching", as described in the European application 95202464.4, incorporated herein by reference. According to this method, during the abovementioned cooling step c), the grease is cooled from the mixing temperature to room temperature in 1 sec.–3 min, preferably 10 sec.–1 min., more preferably 30 sec. This quenching of the lubricant grease composition can be carried out, for instance, by pouring the grease composition on a water-cooled metal plate, although any other suitable rapid cooling method may also be used, such as spraying.

The quenching process according has a major influence on the grease structure, giving significant improvement of the lubricating properties of the final grease compositions as described in the European application 95202464.4, incorporated herein by reference, and compared to both conventional lubricating greases, as well as polymer thickened conducting lubricating greases of the invention which are cooled slowly, e.g. in approximately 1 degree per minute by the use of conventional cooling methods, such as simply keeping the grease in the reaction vessel with external/internal cooling, which can result, for the polymer grease, in a lubricant lacking any mechanical stability and or lower conductivity.

In the polymer-thickened lubricating grease according to the invention, the polymeric thickener forms a sponge-like structure, which gives the grease its appearance and structure. The lubricating base oil is kept within the pore-like spaces within the thickener structure, and bleeds out during service of the grease. Also, the solid particles or liquid droplets of the electrically conductive component (if it forms a separate phase within the grease) can be kept within the thickener structure.

In greases which are slowly cooled during their preparation, the thickener-structure is very irregular with large pores as well as very small pores. The above indicated quenching of the lubricant grease composition provides a grease according to the invention with a smoother and more uniform structure of the polymeric thickener, with more uniformly distributed spaces for keeping the lubricant oil and the solid particles or liquid droplets of the electrically conductive component.

Although in its broadest sense the invention is not restricted to any method for preparing the conducting grease, nor to any explanation as to how the improved properties of the grease composition according to the invention are obtained, it is believed that this smoother and more uniform thickener structure obtained by quenching has a beneficial influence on the final properties of the grease composition, such as the conductivity, the mechanical properties and the further lubrication properties, as well as the transport of the oil and/or the conductive component 3 within the grease structure.

Therefore, although Applicant is not limited to any specific hypothesis, the following explanations are offered for the improved conductivity obtained via the use of a polymeric thickener:

the presence of a polymeric thickener provides for improved contact between the conducting component 3, especially the conducting particles, in the grease and the bearing surfaces, especially at high bearing speeds;

the presence of the polymeric thickener provides for a better structure of the grease, works as a matrix for the electrically conducting particles or provides for better mechanical stability, which results in more uniform distribution and better contact of these particles in the matrix and over the bearing surfaces, especially at high bearing speeds.

due to the electrically conducting component 3 and 3 polymeric thickener can form a layer on the bearing surfaces, which reduces the distance between said surfaces, thereby lowering the electric resistance.

After the grease lubricant composition is cooled, preferably quenched, the grease is "worked" to the required final consistency in a conventional manner, for instance in a three-roll mill or a grease worker. During the working of the grease, further additives can be added as is well known to a man skilled in the art. After working, the grease is ready for use.

The mechanical stability of the grease can be ascertained by means of tests known in the art, such as the Shell roll stability test. Preferably, the grease will have a penetration after the Shell roll stability test (24 hrs at 60° C., 165 rpm), of max. 350.

The consistency of the grease can be classified by means of the NLGI-class. According to the present invention the grease can usually be prepared to a NLGI-class range 1 to 3. An NLGI-class of 0 can be made, however, will usually give undue grease leakage.

It must be understood, however, that the present invention allows the man skilled in the art to obtain a grease with the consistency and mechanical stability as desired and/or required for the intended application of the grease by selecting the components as well as the conditions for preparing the grease, which aspects fall within the scope of a man skilled in the art of lubricants.

Also, the viscosity of the separated oil must be acceptable, and preferably be constant.

The polymer thickened conductive grease composition of the invention can be used in any application in which the use of a conductive lubricant is desired. Furthermore, the conducting greases of the invention can be used for applications for which conventional conducting lubricants are unsuited because of their inadequate lubricating properties.

The electrically conducting lubricating greases can be of great advantage in for instance electrical contacts, such as sliding contacts bearing applications, especially automotive roller bearing applications, such as in automotive wheel bearing units applications in which the build up of static electicity and the accompanying danger of spark formation should be avoided, such as under conditions of explosion hazard in the mining industry, applications in apparatus which convert electrical energy into mechanical energy and visa-versa, such as electric motors and alternators.

The lubricating greases of the invention are especially suited for use in roller bearings with rotating electrical contacts, such as the bearing described in U.S. Pat. No. 5,139,425 (Davies et al, assinged to applicant), incorporated herein by reference.

The invention therefore further relates to the use of a conducting lubricant grease composition for preventing or reducing the build up static electricity in a bearing, for preventing or reducing spark formation, in roller bearings with rotating electrical contacts, in apparatus which convert electrical energy into mechanical energy and visa-versa, and for the conducting of electricity through a bearing and/or between the bearing parts or surfaces.

Figure 2A:
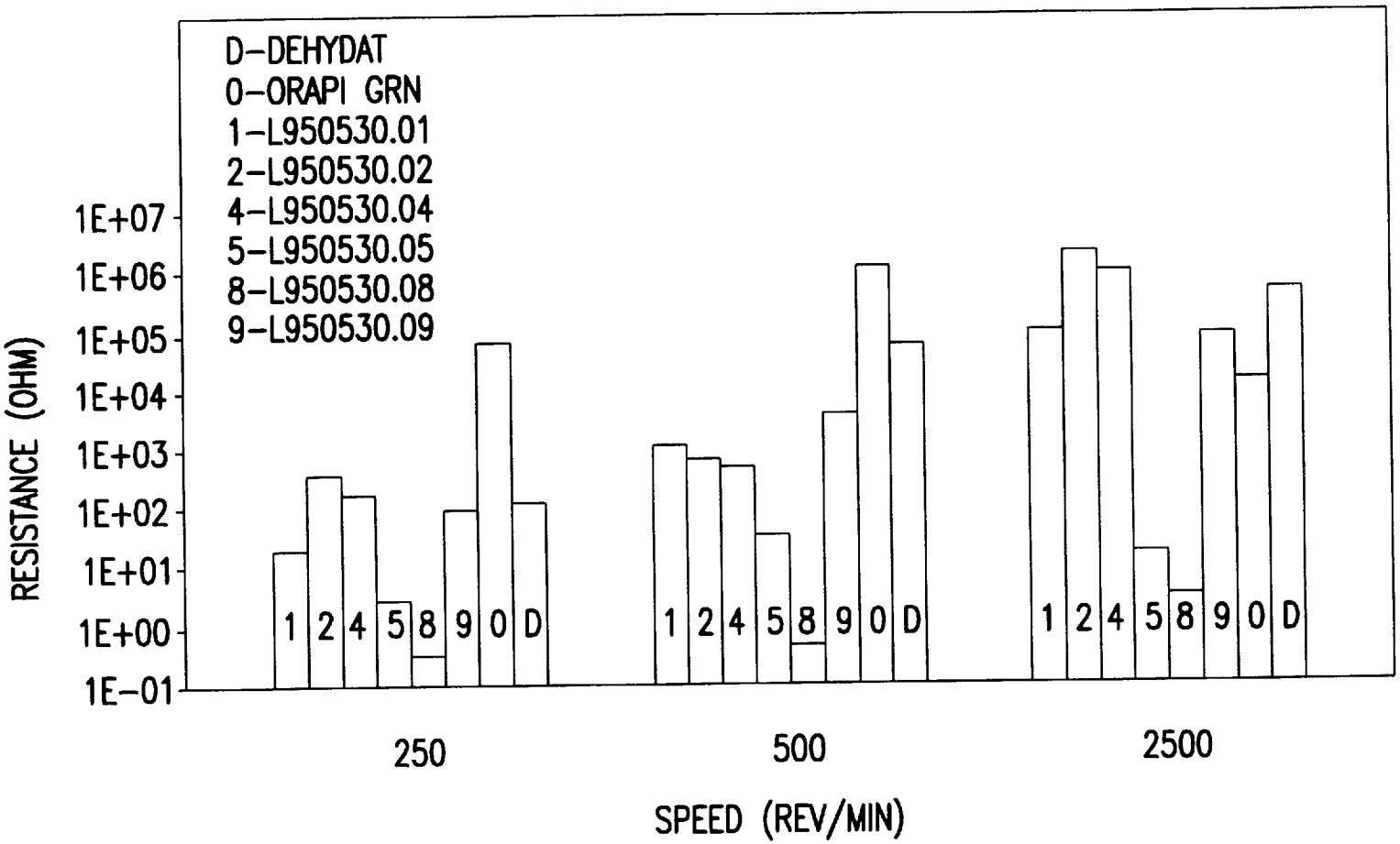
FIGS. 2*a* and 2*b* are diagrams showing the resistance of known lubricants and lubricants of the invention in roller bearing tests.
Figure 2B:
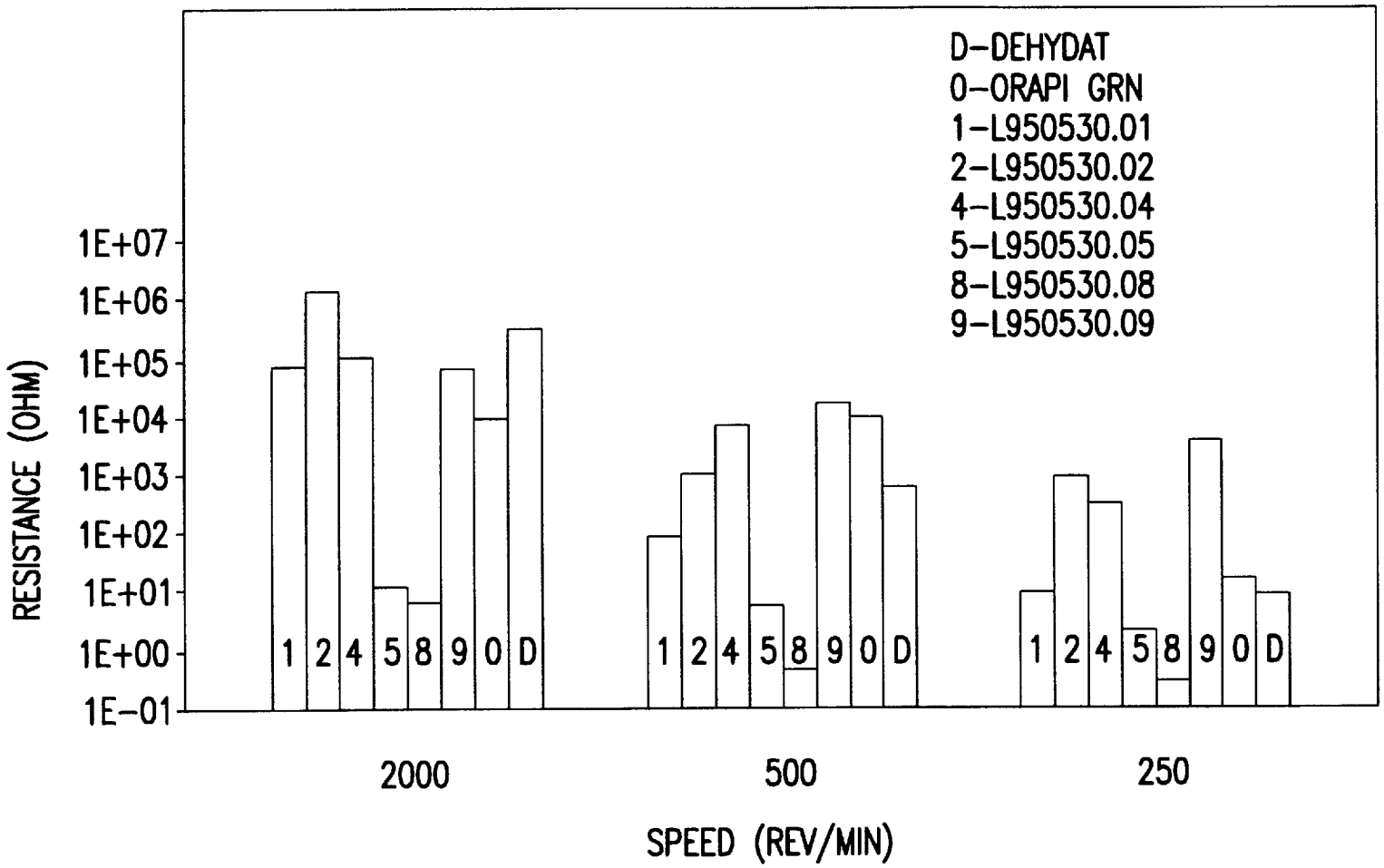

The invention will now be described further by means of the following Example and figures, in which the FIGS. 1 and 2*a*/2*b* are diagrams showing the resistance of known lubricants and lubricants of the invention in static (FIG. 1) and roller bearing tests (FIGS. 2*a* and 2*b*).

EXAMPLE

A screening test of the formulated polymer greases and a commercially available 'conductive' grease used in bearing Hub unit development was evaluated.

A total of nine polymer greases were prepared. Table 1 shows all greases employed in this study.

TABLE 1

Test greases

| ERC-Code | Grease Composition (Supplier) |
|---|---|
| L950530.01 | Base Grease* |
| L950530.02 | Base Grease + 10% Dehydat 51 (Henkel) |
| L950530.03 | Base Grease + 5% Dehydat 51 |
| L950530.04 | Base Grease + 1% Dehydat 51 |
| L950530.05 | Base Grease + 1% Dehydat 51 + 1% Graphite, size 1–2 μm |
| L950530.06 | Base Grease + 1% Graphite, size 1–2 μm |
| L960530.07 | Base Grease + 1% Graphite, size < 1 μm |
| L950530.08 | Base Grease + 1% Niobium (IV) sulfide (Johnson Matthey) |
| L950530.09 | Base Grease + 1% Dehydat 51 + 1% Graphite, size < 1 μm |
| L950530.10 | ORAPI GRN (Orapi) |

*Base Grease Composition:
- 10% Polymer
- 1% Irganox L-57
- 6.7% Liovac 3016
- 82.3% Ester base oil (When adding a compound to the base grease, the base oil content is reduced by the same amount)

FIG. 1 shows the results of the screening electrical conductivity grease tests. The technique employed a pair of copper electrode (10 mm apart) and an applied voltage 500V. This method is similar to the standard technique described in DIN 53482 (Method of test for material for electrical purposes: measuring of electrical resistance of non-metallic material). It is seen that the formulated polymer greases tested gave much lower electrical resistivity than the reference grease (Orapi GRN) selected for the seal/flinger contact in the Hub unit development. The best grease in terms of conductivity was the base grease with 10% Dehydat 51 (an anti-static material). The conducting solids such as graphite or Niobium sulfide did not give any improvement in conduction, thus suggesting that under static test condition, suspended solids in polymer and/or in oil inhibit or retard the flow of electrical current. The amount of conducting solid used and the orientation of the solid in the polymer-oil grease structure could be an important factor in forming electrical conductive bridges.

The electrical resistance/resistivity of the polymer greases in a standard DGBB 6205 bearing was measured as follows. The DGBB 6205 bearing was mounted on a SKF A-O spindle and housing. The SKF A-O spindle was driven by a flat belt pulley and an electrical drive motor, which is controlled by a frequency convertor. This enables the spindle speed to operate between 0 and 3000 rpm. The load is applied mechanically to the test bearing by means of rotating the nuts located on the threaded bar which is connnected to the test bearing housing. The applied load is monitored by means of a load cell and strain indicator, and can be varied from 0–3000N (radial load). The resistance through the bearing is measured, and the data is acquired and processed using general purpose equipment.

In this study, the electrical resistance across the rolling contacts was measured using a calibrated multimeter (ohm meter) Fluke 8024B. The test conditions employed is shown in Table 2.

At each speed step, the average electrical resistance was recorded after running for about 5 minutes. FIGS. 2*a*+2*b* show the electrical resistance measurements of 8 test samples.

TABLE 2

Bearing test conditions at ERC

| | |
|---|---|
| Test Bearing | SKF 6205 2RZ/C3 |
| Speed (rev./min) | step up 250, 500, 2500<br>step down 2000, 500, 250 |
| Load | 2100 N |
| Amount of Grease in Bearing | 1.6 g |

It is seen that grease containing conductive solids, in particular, Niobium sulfide (sample L950530.08) and graphite, size 1–2 μm, (sample L950530.05) shows very low contact resistance at all range of speeds. Surprisingly, the addition of Dehydat alone to the base grease did not significantly increase the electrical field strength or conductivity. Dehydat (100%) was also measured and showed relatively high contact resistance at high speeds. At low speeds, the anti-static agent indicated much better conductivity. It is evidenced that under rolling contact condition, the base grease or the same grease containing anti-static agent works well at low running speeds. At high speeds, grease containing conducting solids is essential in order to reach a lower resistivity in rolling bearing contacts indicating that the conducting solids in polymer/oil film provide a better electrical circuit between the surfaces. The reference grease, Orapi GRN shows much higher contact resistance compared to some of our own test greases.

As can be seen from the results of this study, polymer greases containing anti-static material and/or conducting solids can easily provide the properties needed for discharging static electricity through rolling bearings. The developed greases gave much lower contact resistance than the best known commercial 'conductive grease'. Polymer greases such as samples L950530.08 and L950530.05 show excellent conductivity performance in bearings. This shows that greases can be developed for electrical conduction.

What we claim is:

1. Method of preparing an electrically conducting lubricant and grease composition, comprising mixing a copolymer or homopolymer of propylene with a weight average molecular weight of 200,000 or more and a copolymer or homopolymer of propylene with a weight average molecular weight of 100,000 or less to form a polymeric thickener and mixing with the polymeric thickener a lubricating base oil and an electrically conducting component.

2. Electrically conducting lubricant grease composition comprising a lubricating base oil, a polymeric thickener, and an electrically conducting component, wherein the polymeric thickener comprises a mixture of a copolymer or homopolymer of propylene with a weight average molecular weight of 200,000 or more and a copolymer or homopolymer of propylene with a weight average molecular weight of 100,000 or less.

3. Electrically conducting lubricant grease composition according to claim 2, wherein the electrically conducting component comprises one or more materials selected from the group consisting of metal containing additives, anti-static agents, and electrically conducting solids.

4. Electrically conducting lubricant grease composition according to claim 2, wherein the ratio between the high molecular weight component and the low molecular weight component of the polymeric thickener is 1:40–1:5.

5. Electrically conducting lubricant grease composition according to claim 4, wherein the low molecular weight component is a polypropylene homopolymer with an average molecular weight between 50,000 and 100,000 with a melt flow rate (ASTM D1238) of 500–1000.

6. Electrically conducting lubricant grease composition according to claim 4, wherein the high molecular weight component is a polypropylene homopolymer or a propylene/ethylene-copolymer with an average molecular weight of 200,000–250,000 and a melt flow rate (ASTM D-1238) of 1.5–15.

7. Electrically conducting lubricant grease composition according to claim 3, wherein the metal containing additives are selected from the group consisting of organometallic compounds and bismuth compounds.

8. Electrically conducting lubricant grease composition according to claim 3, wherein the antistatic agents are antistatic agents for polymer applications.

9. Electrically conducting lubricant grease composition according to claim 3, wherein the electrically conducting solids are soft metal particles selected from the group consisting of bismuth, silver, copper, graphite and niobium (IV) sulfide.

10. Method of simultaneously lubricating and preventing or reducing the build up static electricity or preventing or reducing spark formation, comprising applying to a material susceptible to static electricity build up or spark formation the electrically conducting lubricant grease composition according to claim 2.

11. Method according to claim 10, wherein the material is roller bearings with rotating electrical contacts or an apparatus which converts electrical energy into mechanical energy and visa-versa.

12. Method of simultaneously lubricating and conducting electricity through a bearing or between the bearing parts or surfaces, comprising applying to the bearing the electrically conducting lubricant grease composition according to claim 2.

13. Electrically conducting lubricant grease composition according to claim 2, wherein the electrically conducting lubricant grease composition has a resistance at ambient temperature of less than 100 ohm.

14. Electrically conducting lubricant grease composition according to claim 13, wherein the electrically conducting lubricant grease composition has a resistance at ambient temperature of less than 1 ohm.

15. Electrically conducting lubricant grease composition according to claim 2, wherein the electrically conducting lubricant grease composition further comprises lubricant additives.

16. Electrically conducting lubricant grease composition according to claim 2, wherein the electrically conducting component comprises a combination of at least two materials selected from the group consisting of metal containing additives, anti-static agents, and electrically conducting solids.

17. Electrically conducting lubricant grease composition according to claim 4, wherein the ratio between the high molecular weight component and the low molecular weight component is 1:25–1:15.

18. Electrically conducting lubricant grease composition according to claim 7, wherein the metal containing additives are especially bismuth containing grease additives.

19. Method for preparing a conducting lubricant grease composition, comprising mixing or dissolving a polymeric thickener with or in a lubricating base oil at a mixing temperature above melting point of said polymeric thickener to obtain a first composition, incorporating into said first composition an electrically conducting component, cooling the grease composition thus obtained from the mixing temperature to room temperature in 1 sec.–3 min., and working the grease to the required consistency, wherein the polymeric thickener comprises a mixture of a copolymer or homopolymer of propylene with a weight average molecular weight of 200,000 or more and a copolymer or homopolymer of propylene with a weight average molecular weight of 100,000 or less.

20. Grease composition obtainable according to method of claim 19.

* * * * *